United States Patent [19]

Mershon et al.

[11] 4,276,762

[45] Jul. 7, 1981

[54] JOGGLING MACHINE

[75] Inventors: Butler A. Mershon; Keith A. Wilhelm, both of Burbank, Calif.

[73] Assignee: Lockheed Corporation, Burbank, Calif.

[21] Appl. No.: 957,692

[22] Filed: Nov. 6, 1978

[51] Int. Cl.[3] ..... B21D 11/18

[52] U.S. Cl. ..... 72/13; 72/316; 72/430; 72/446

[58] Field of Search ..... 72/316, 322, 342, 357, 72/446, 447, 13, 430

[56] References Cited

U.S. PATENT DOCUMENTS 2,040,474 5/1936 Geib, Jr. ..... 72/13

2,303,059 11/1942 Misfeldt ..... 72/342

3,495,527 2/1970 Lafreniere ..... 72/446

*Primary Examiner*—Lowell A. Larson

*Attorney, Agent, or Firm*—Frederic P. Smith

[57] ABSTRACT

A joggling machine including a joggling tool for forming an indentation in a workpiece comprising means for securing the workpiece, means for heating the workpiece to a preselected temperature, means for moving the joggling tool and the workpiece into proximity with one another and means for actuating the joggling tool. Interlocks and circuitry are provided to effect safe automatic sequencing of the joggling machine. A universal form die and a multiple chambered magazine assist in the efficient operation of the joggling machine.

34 Claims, 18 Drawing Figures

FIG. 7
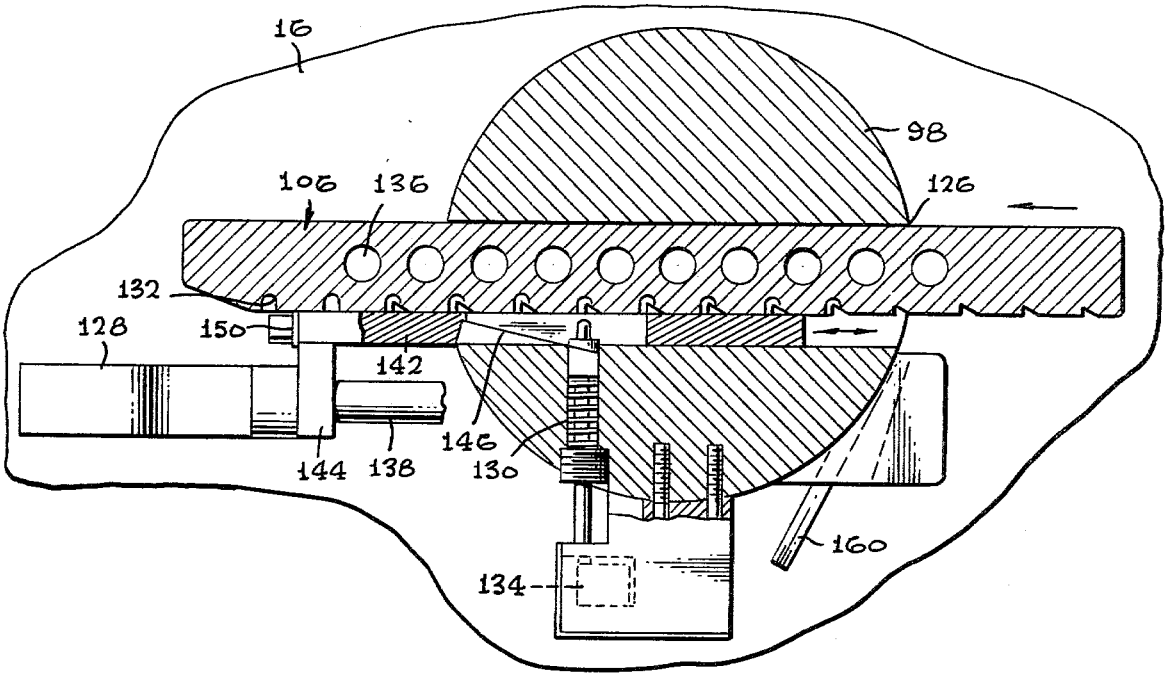
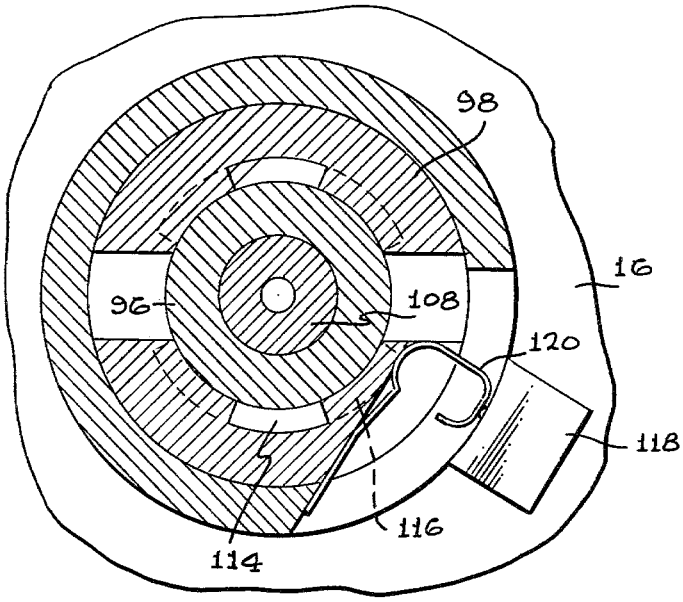
FIG. 8

FIG. 12
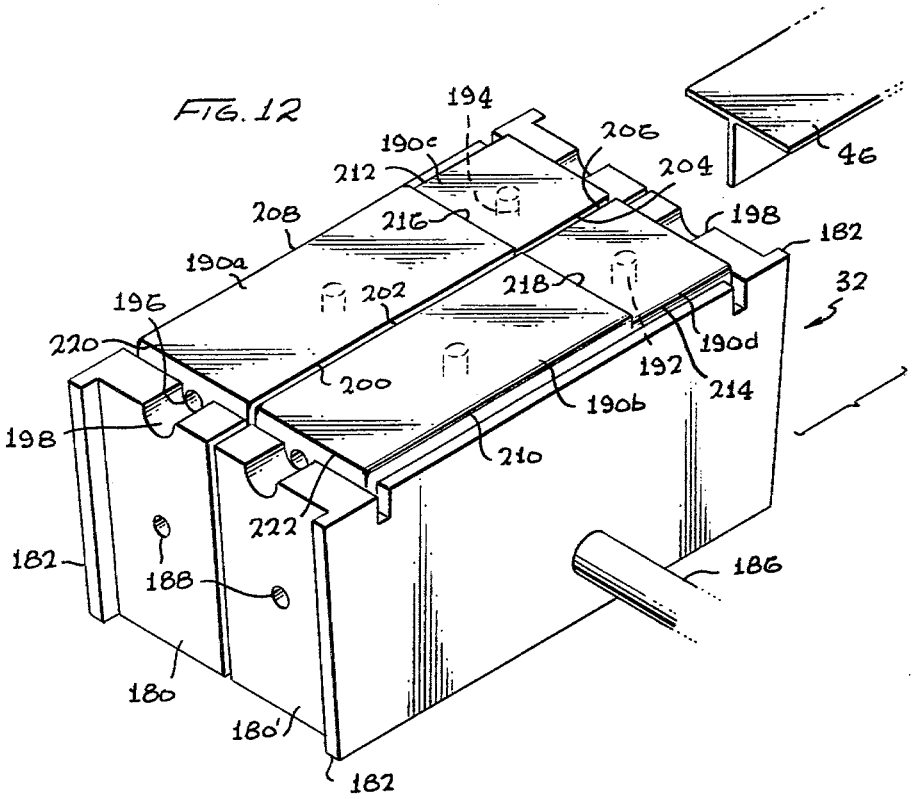
FIG. 13
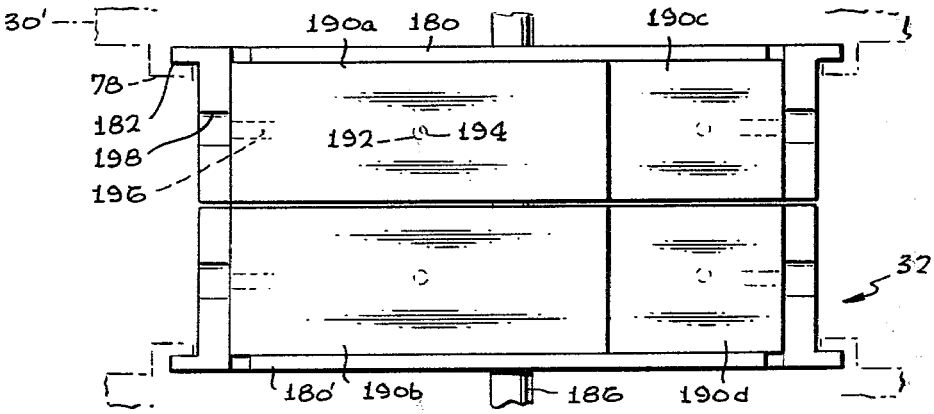
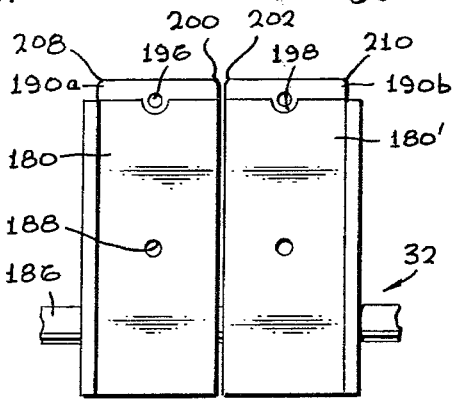
FIG. 14

460V
CB-1
T1
115/230V
TIC-1
40a
K2-1
TE-1
222
C1
4,5
TIC-2
40b
K2-2
TE-2
224
C2
6,7
TIC-3
40c
TE-3
226
To FIG. 16B
H1
30
C1-1
C1-2
C2-1
C2-2
H2
30'
V G
102
FIRING PIN
K4-1
T2
230V
24V
ON
OFF
S1
P1
P5
S4
MAN.
AUTO
S3
OPEN
CLOSE
K3-1
K1
8,11
TD 1
16 (10 SEC. INTERVAL)
S2
ON
OFF
K1-1
TD2-1
K2
1,2
K3-2
P2
K3
7B, 9, 12, 13, 14, 15, 15, 16
P4
TO FIG. 16B

FROM FIG. 16A
TD2
8 (.2 SEC. INTERVAL)
10
V1
PART CLAMP
11
K1-2
P3
48
C
N.O
GANTRY BRIDGE OPEN
LS 1
50
LS 2
PART CLAMP
K3-3
TEMP SENSOR
12
K5-1
ON
OFF
TD3-1
V 2
13
S5
K3-4
TD3-2
TD-3
14
12, 14 (10 SEC. INTERVAL)
K3-5
15
S6
K3-7
K3-6
A1
TD5-2
K3-8
TD5-1
V 3
GANTRY BRIDGE
16
TD1-1
K5-2
122
FORMING PUNCH
LS 3
FROM FIG. 16A
178
TEMP. SENS.
LS 4
68
GANTRY BRIDGE CLOSED
LS 5
V 4
R.H. HOLD DOWN CLAMP
17
K5-3
S7
P6
V 5
L.H. HOLD DOWN CLAMP
S8
P7
134
LS 6
118
BREECH ASSEMBLY
LS 7
INDEXING PIN
S9
7A
K-4
S10
TD4
18 (10 SECOND ON DELAY)
P8
A2
K-5
18
TD4-1
12, 16, 17, 19
TD-5
19
K5-4
16, 16 (2 SECOND INTERVAL)

JOGGLING MACHINE

BACKGROUND OF THE INVENTION

1. Field of the Invention

The invention relates to the field of forming devices, and, in particular, to joggling machines for forming indentations in workpieces.

2. Description of the Prior Art

It is often desirable to place a joggle or an indentation in a workpiece. Typically, the workpiece will consist of a member having a T-shaped cross-section and the joggle will involve forming an indentation in the workpiece along its linear section so that a dip is experienced going along the linear length of the T. While many techniques have been devised to form this joggle or indentation, one of the more successful techniques is shown in U.S. Pat. No. 3,827,278, issued Aug. 6, 1974, entitled "JOGGLING TOOL", and assigned to the same assignee as the present invention. In this patent, a joggling tool is explosively actuated to release energy at a high rate to a forming punch which physically imparts a force to a workpiece held in a form die to accomplish the joggle or indentation therein. While this joggling tool is satisfactory for the production of individual joggles, it does not lend itself to the rapid production of joggles in a series of workpieces and to the forming of joggles in workpieces that must be kept heated to a particular temperature during the joggling process. This deficiency exists, essentially, because the workpiece, the form die, and the joggling tool have to be accurately realigned for each workpiece to be joggled, the breach has to be opened after each explosive charge has been actuated and there is no control over the temperature of the part to be hot-joggled. In addition, it is complicated, time consuming and expensive to make changes in the form die used in combination with the punch member in such joggling tool to accomplish the joggle in the workpiece.

Accordingly, it is a general object of the present invention to provide a joggling machine for forming an indentation in a workpiece.

It is another object of the present invention to provide a joggling machine which allows for easy and rapid positioning and alignment between the form die, the workpiece and the joggling tool.

It is a further object of the present invention to provide a joggling machine in which the temperature of the workpiece can be accurately regulated to allow for the hot-joggling thereof.

It is still another object of the present invention to provide a joggling machine which can be rapidly and sequentially activated to quickly form a succession of joggled workpieces.

It is a further object of the present invention to provide a joggling machine in which form die changes can be made rapidly and inexpensively.

SUMMARY OF THE INVENTION

A joggling machine for forming an indentation in a workpiece is provided. The joggling machine comprises means for securing the workpiece, means for heating the workpiece to a preselected temperature, means for moving the joggling tool and the workpiece into proximity with one another and means for actuating the joggling tool. A universal form die and a multiple chambered magazine assist in the efficient operation of the joggline machine. Interlocks and circuitry are provided to effect safe automatic sequencing of the joggling machine.

The novel features which are believed to be characteristic of the invention, both as to its organization and method of operation, together with further objects and advantages thereof, will be better understood from the following description in connection with the accompanying drawings in which a preferred embodiment of the invention is illustrated by way of example. It is to be expressly understood, however, that the drawings are for purposes of illustration and description only, and are not intended as a definition of the limits of the invention.

BRIEF DESCRIPTION OF THE DRAWINGS

FIG. 7 is a cross-sectional view of the joggling tool of the present invention taken along the lines 7—7 of FIG. 4;

FIG. 8 is a cross-sectional view of the joggling tool of the present invention taken along the lines 8—8 of FIG. 4;

FIG. 12 is a perspective view of the form die of the present invention;

FIG. 13 is a top plan view of the form die illustrated in FIG. 12;

FIG. 14 is an end plan view of the form die illustrated in FIG. 12;

DESCRIPTION OF THE PREFERRED EMBODIMENT

Figure 1:
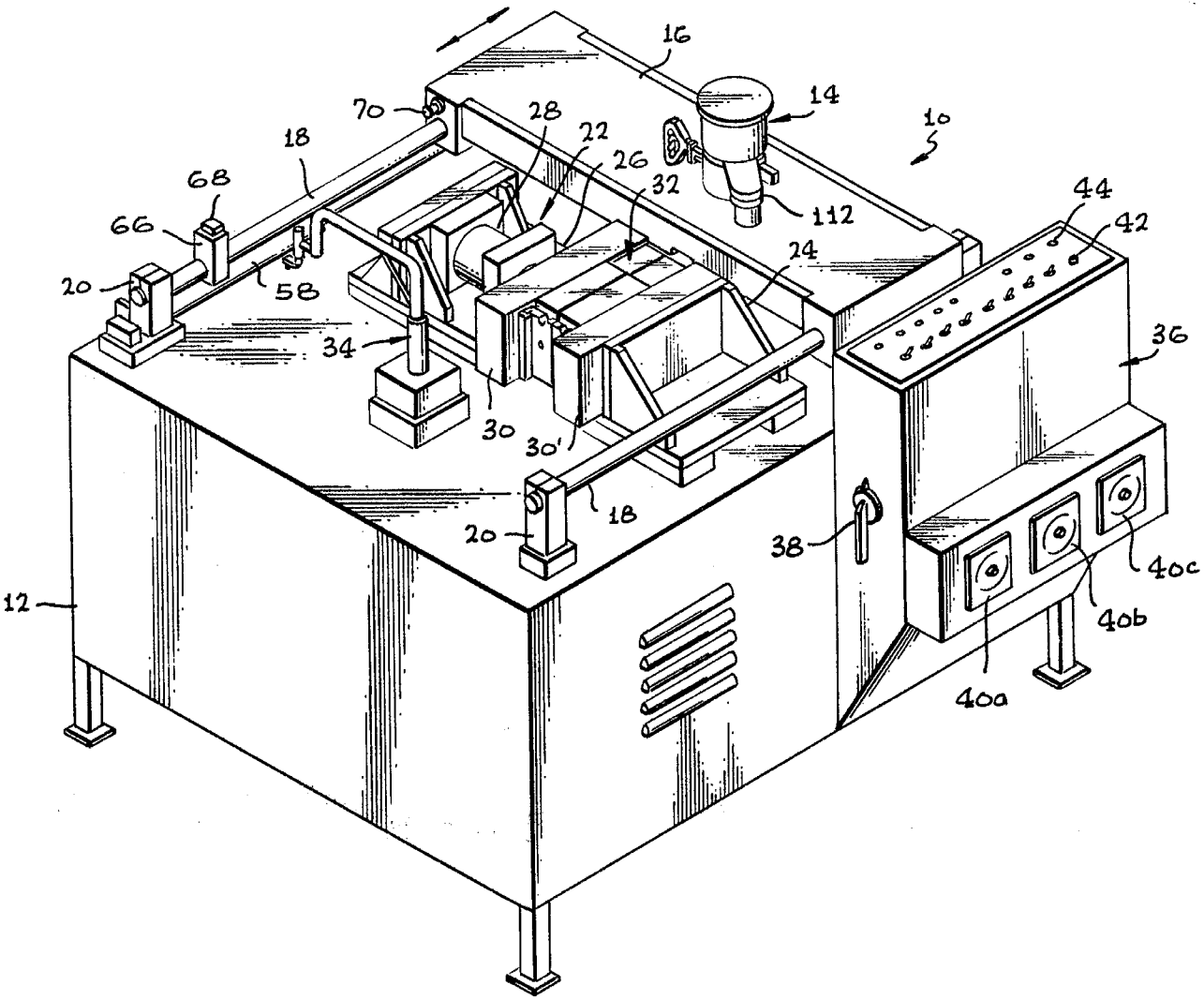
FIG. 1 is a perspective view of the joggling machine of the present invention.

In FIG. 1 the joggling machine of the present invention is illustrated. The joggling machine 10 includes a cabinet 12 on which is mounted a joggling tool 14 supported by a gantry bridge 16, gantry support rails 18 and gantry support posts 20. The workpiece to be joggled is held in position by clamp 22 which includes a stationary jaw 24 and a movable jaw 26 actuated by a pneumatic clamp cylinder 28. Coupled to the clamp 22 are a pair of heater platens 30, 30' which heat the form die 32 and the workpiece up to the desired temperature before the joggling thereof. The precise shape to which the workpiece is to be joggled is determined by form die 32 positioned in the clamp 22 between the heater platens 30, 30'. The temperature of the workpiece is sensed by temperature sensor 34 which, as explained hereafter, pivots and positions a thermocouple in contact with the workpiece and then retracts to its original position when a desired workpiece temperature has been reached. The joggling machine 10 is operated from the operator console 36 which includes a power switch 38, temperature gauges 40 *a, b* and *c*, operating switches 42 and indicator lights 44. While the operation of the joggling machine 10 will be explained more fully hereafter, in brief, the workpiece is placed in the form die 32 and secured by clamp 22, is heated by heater platens 30, 30' and is joggled by joggling tool 14 which is carried over the workpiece by the movement of the gantry bridge 16, actuated and then returned to its original position at the right edge of the cabinet 12.

Figure 2:
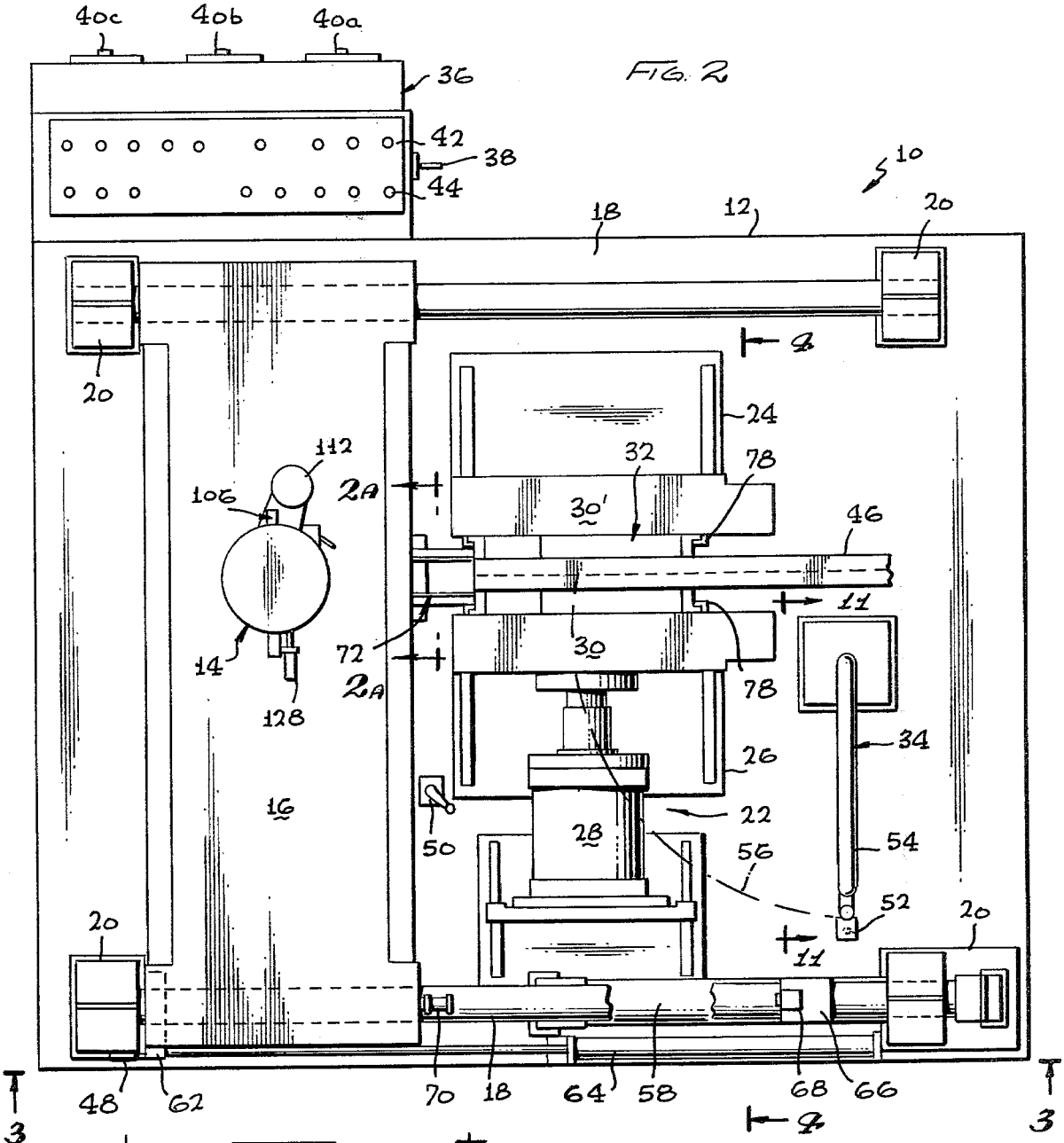
FIG. 2 is a top plan view of the joggling machine illustrated in FIG. 1.
Figure 3:
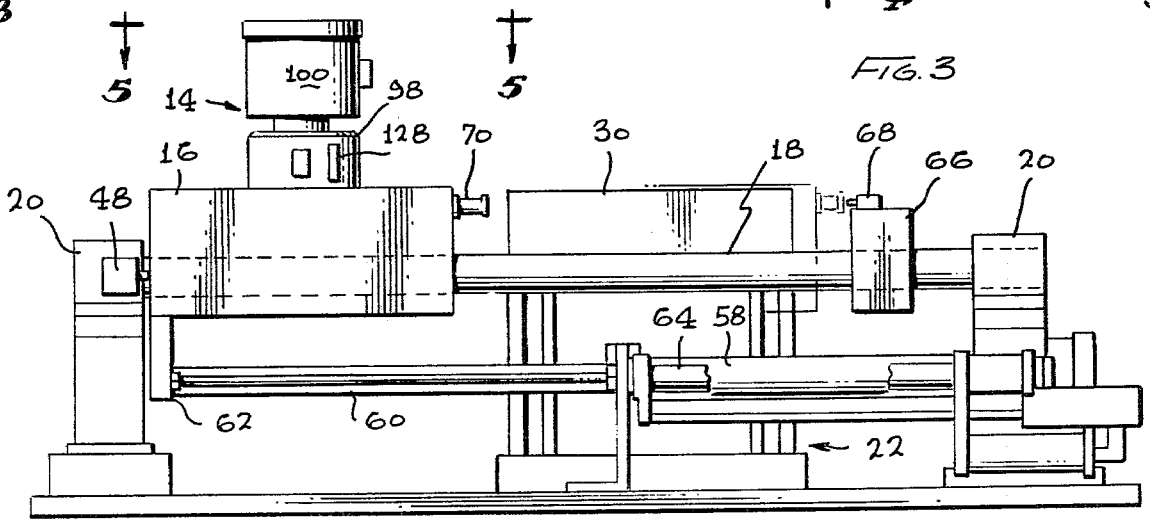
FIG. 3 is a side view of the joggling machine illustrated in FIG. 1 taken along lines 3—3 of FIG. 2.

Referring now to FIGS. 2 and 3, a workpiece 46 is shown inserted in the form die 32 and held in place by clamp 22. The joggling tool 14 and the gantry bridge 16 are shown in the gantry bridge open position contacting microswitch 48. Microswitch 50 operates to indicate that the clamp 22 is in the closed position engaging the form die 32 and the workpiece 46. Temperature sensor 34 having a thermocouple 52 at the extremity of arm 54 thereof is shown positioned to swing over and contact the workpiece 46 to sense the temperature thereof, as shown by the dashed line 56. When the workpiece 46 reaches the desired temperature and microswitches, described hereafter, indicate that the temperature sensor 34 is in the retracted position and that the joggling tool 14 is ready for actuation, gantry bridge 16 is actuated by pneumatic cylinder 58 coupled to gantry bridge 16 by shaft 60 and bracket 62 for movement over the workpiece 46, as shown in phantom. In order to smooth the movement of gantry bridge 16 and joggling tool 14 and to prevent any surging thereof, a hydraulic resistance unit 64, such as a Bellows Hydro-Check, Series B171-3, is positioned behind and parallel to pneumatic cylinder 58 and is coupled to the gantry bridge 16 by the bracket 62.

Figures 2A, 6:
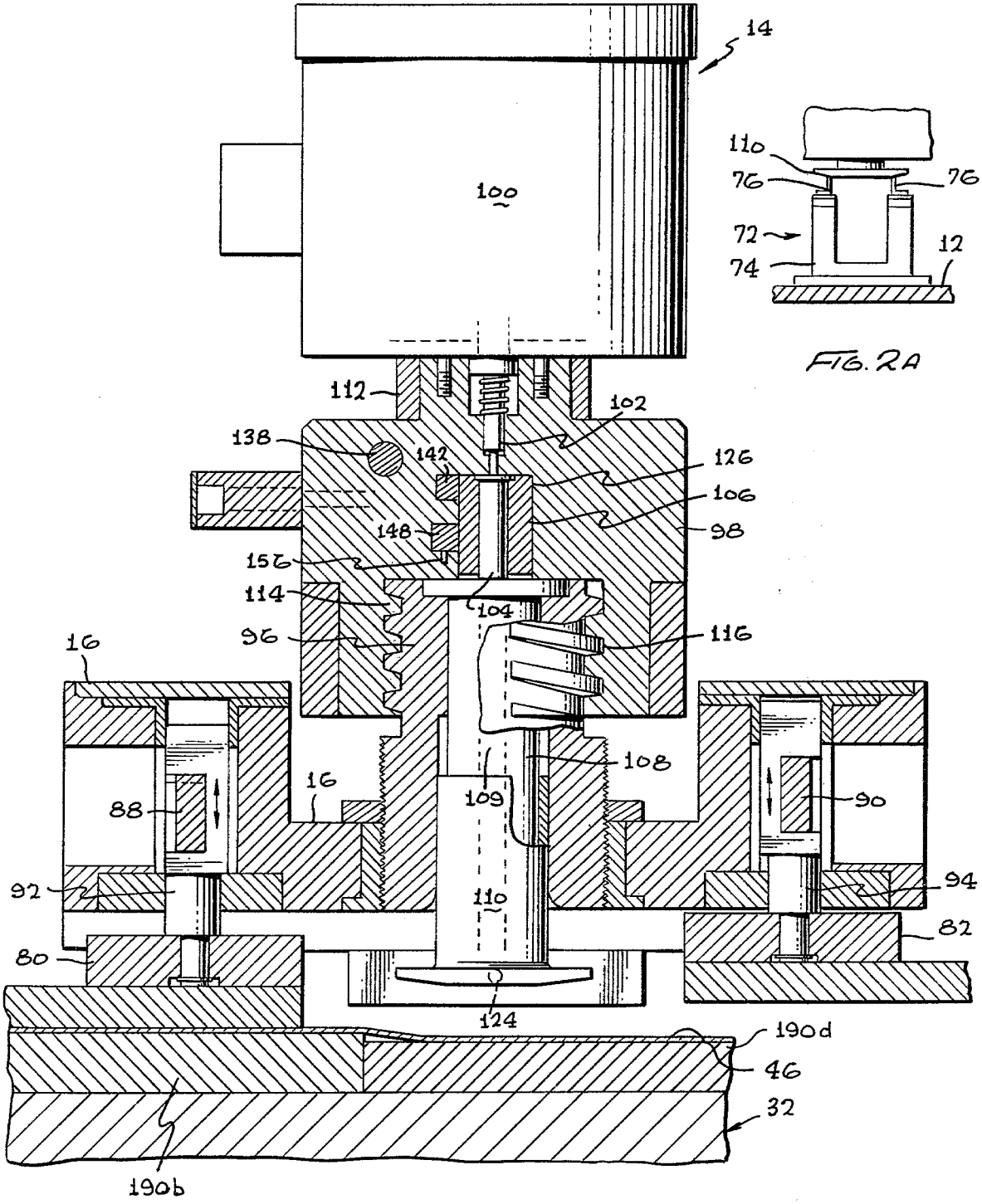
FIG. 2A illustrates the forming punch reset ramps of the present invention taken along the lines 2A—2A of FIG. 2.
FIG. 6 is a cross-sectional view of the joggling tool of the present invention taken along the lines 6—6 of FIG. 4.
Figure 4:
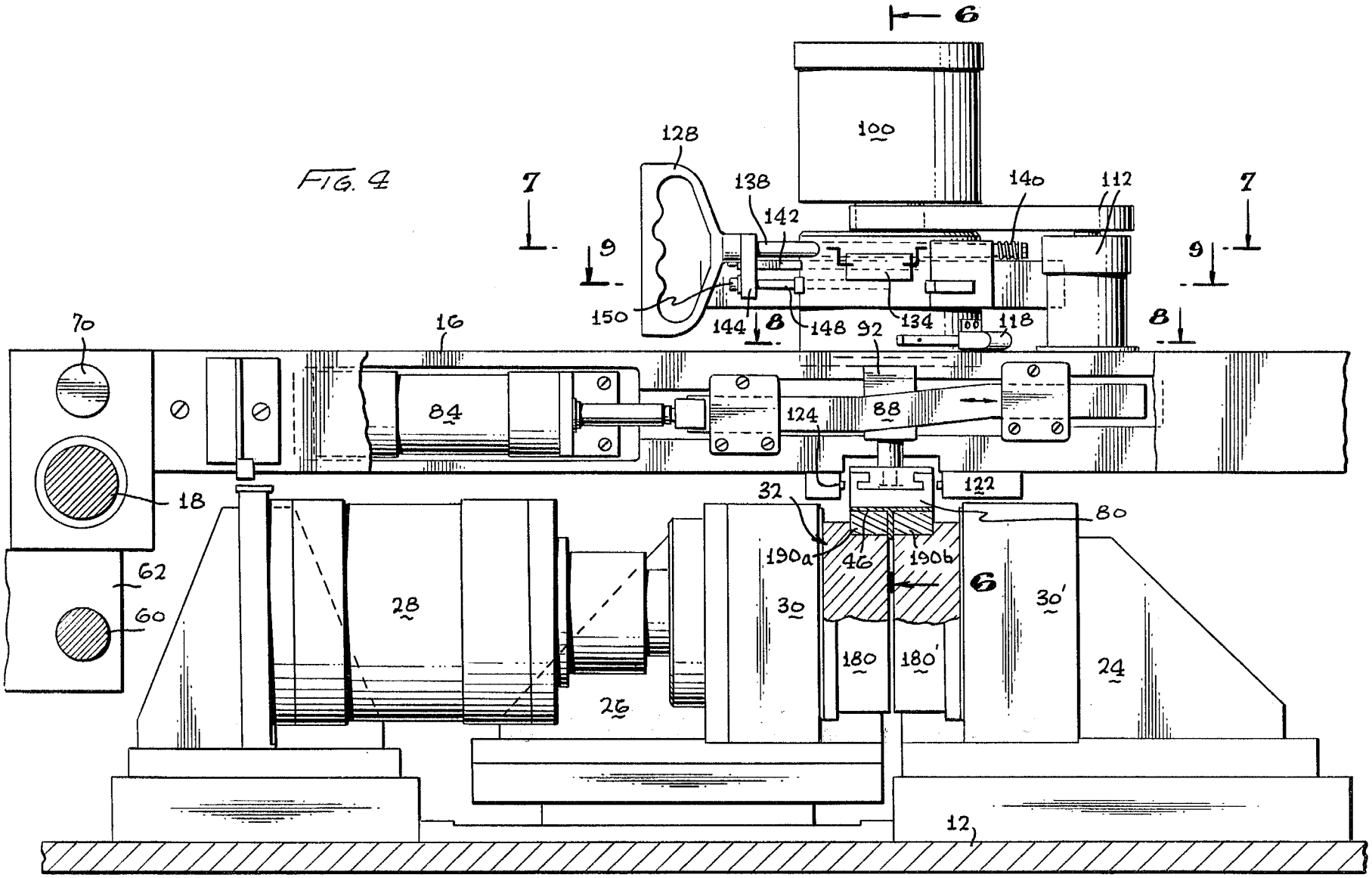
FIG. 4 is a front view, partially broken away, of the joggling machine illustrated in FIG. 1, taken along lines 4—4 of FIG. 1.
Figure 5:
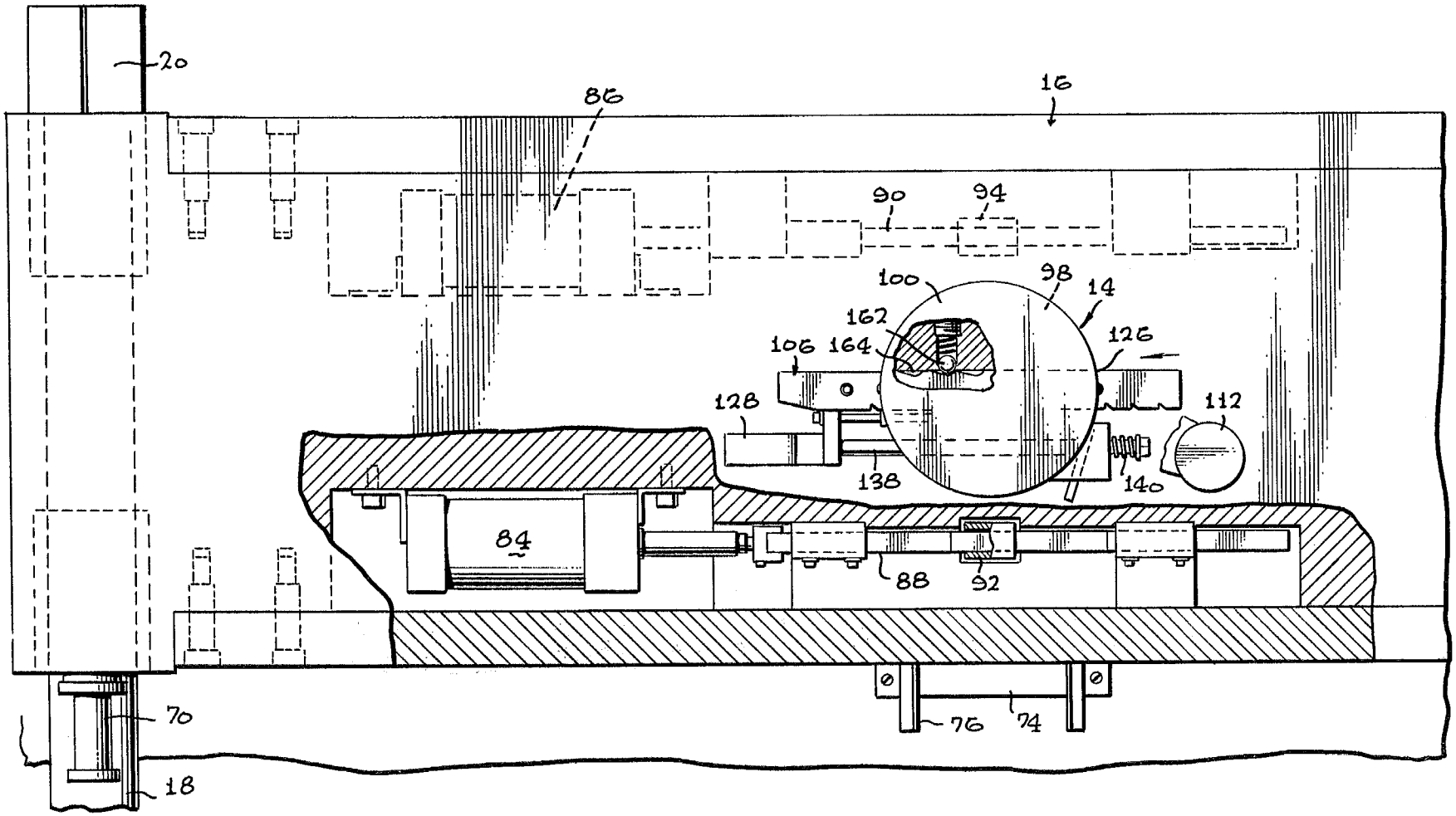
FIG. 5 is a top plan view, partially broken away, of the joggling tool and gantry bridge of the present invention taken along the lines 5—5 of FIG. 3.
Figure 9:
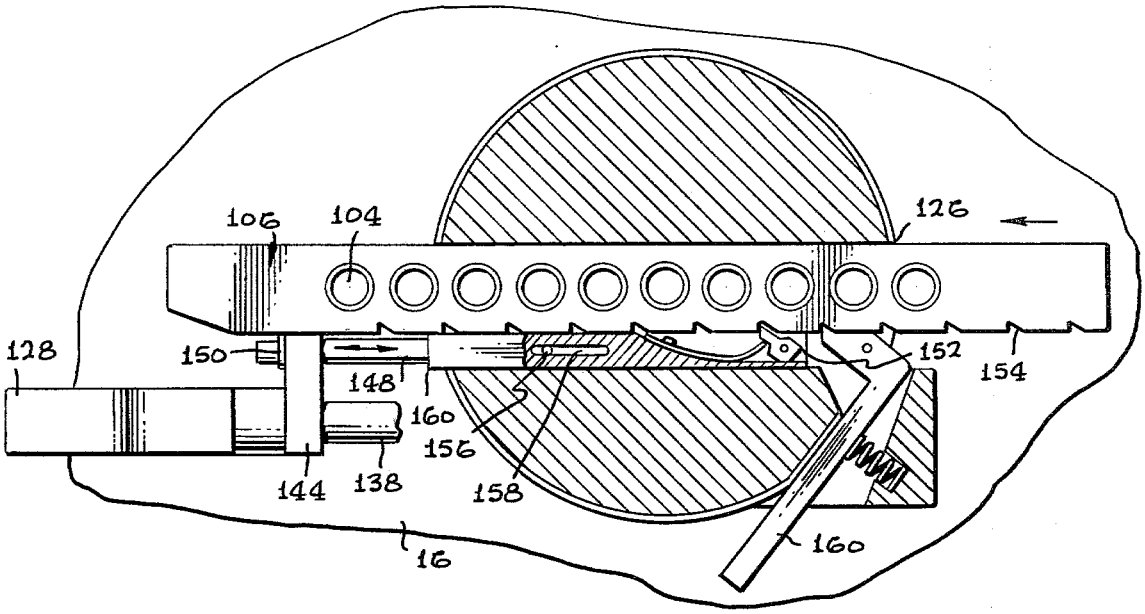
FIG. 9 is a cross-sectional view of the joggling tool of the present invention taken along the lines 9—9 of FIG. 4.
Figure 10:
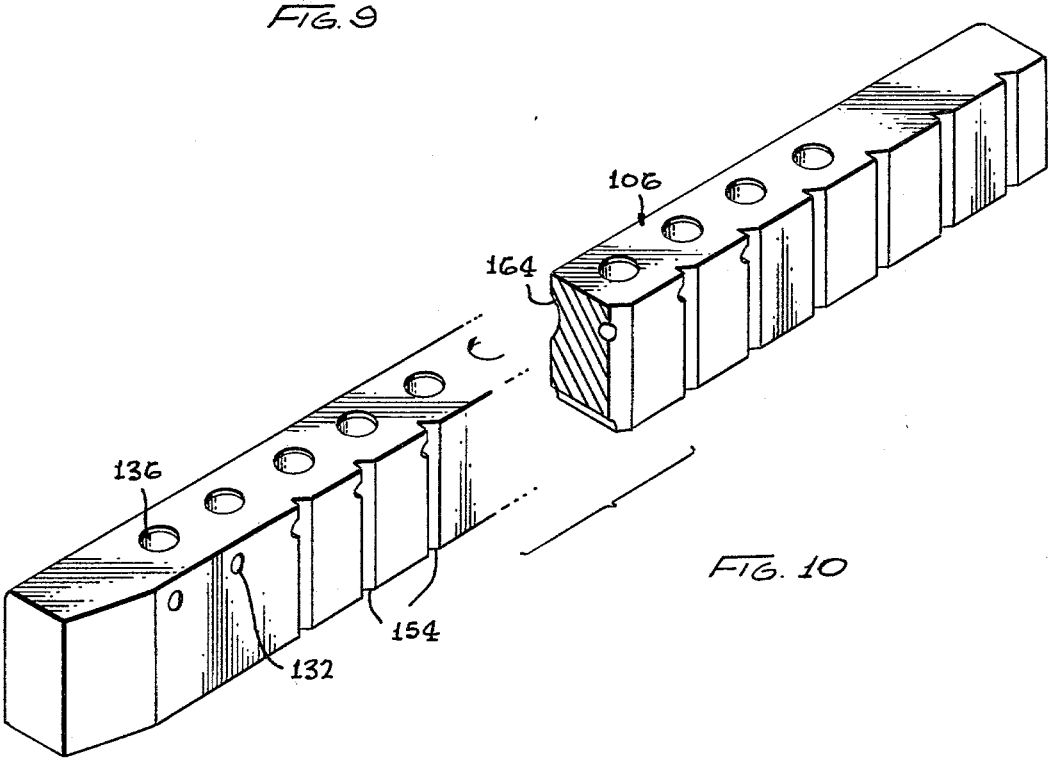
FIG. 10 is a perspective view, partially broken away, of the multiple chambered magazine of the present invention.

The precise positioning of the joggling tool 14 over the workpiece 46 is controlled by gantry stop block 66 having microswitch 68 positioned thereon and gantry stop adjustment screw 70. The contact of the gantry stop adjustment screw 70 with the microswitch 68 indicates that the gantry bridge 16 is in the gantry bridge closed position and that the joggling tool 14 is ready for actuation. After the joggling tool 14 has been actuated (or the sequence aborted), it automatically returns to its original position and punch reset ramps 72, shown more fully in FIG. 2A, reset the forming punch for subsequent operation, as will be more fully explained hereafter. Punch reset ramps 72 comprise a U-shaped pedestal 74 affixed to the cabinet 12 on which are set angles 76 shaped to form a ramp on which the forming punch rides to raise the forming punch to its reset position when the gantry bridge 16 moves back to the gantry bridge open position. Also shown in FIG. 2 are angle brackets 78 which are attached to the heater platens 30, 30' to secure the form die 32 in position. If desired, an additional downward force can be placed on the workpiece 46 by means of a hold-down clamps 80, 82 illustrated in FIGS. 4, 5, and 6. Clamps 80, 82 are actuated by hydraulic cylinders 84, 86 driving angled bars 88, 90 to cause clamp shafts 92, 94 to move clamps 80, 82 in an upward and downward motion.

Referring now to FIGS. 4 through 10, joggling tool 14 comprises an outer barrel 96 threaded into the gantry bridge 16, a breach assembly 98 secured to the outer barrel 96, a solenoid housing 100 mounted on the breach assembly 98 for actuating a firing pin 102 adapted to strike a cartridge 104 mounted in a multiple chambered magazine or cartridge bar 106 seated on an inner barrel 108 having a bore chamber 109 and a forming punch 110 mounted on the lower end thereof. The solenoid housing 100 and breach assembly 98 are suspended on a pivot assembly 112 which is spring loaded to counterbalance the weight of the solenoid housing 100 and breach assembly 98. The pivot assembly 112 provides easy separation of the breach assembly 98 from the outer barrel 96 and swings the breach assembly 98 clear for easy access to the inner barrel 108. The upper part of the outer barrel 96 has an interrupted thread 114 which matches a similar internal interrupted thread 116 within the breach assembly 98 to provide a series of locking lugs which require only a one-quarter turn to secure or release the breach assembly 98 from the outer barrel 96. As is shown in FIG. 8, a microswitch 118 interacts with spring 120 which in turn interacts with the interrupted thread 116 to prevent firing of the cartridge 104 unless the interrupted threads 114 of the breach assembly 98 are fully engaged with the interrupted threads 116 of the outer barrel 96. In a similar manner, forming punch 110 interacts with microswitch 122, shown in FIG. 4, which determines that the forming punch 110 has been raised back to its firing position, where it is held by spring loaded detent pin 124, to insure that the forming punch 110 is in position before the cartridge 104 can be fired.

To utilize the multiple chambered cartridge bar or magazine 106, the cartridge bar 106 is first loaded with cartridges 104, then inserted into the rectangular passage 126 in the breach assembly 98 opposite the actuating handle 128 and slipped forward in the rectangular passage 126 until movement is stopped by the indexing pin 130 within the breach assembly 98 dropping into the first indexing detent 132 in the cartridge bar 106. At this point, the first cartridge 104 is in position to be fired. Microswitch 134 coupled to indexing pin 130 prevents the firing of the cartridge 104 unless the cartridge chamber 136 is in correct alignment with the inner barrel 108. The handle 128 is secured through the breach assembly 98 by slide actuator rod 138 which terminates in spring 140. Progressive positioning of new cartridges into the firing position is accomplished by pulling the handle 128 to its limit and then allowing it to return by the bias of the spring 140. Handle 128 is connected to bar 142, shown in FIG. 7, by connecting bar 144. When handle 128 is pulled to the left, bar 142 also moves to the left causing cam surface 146 to engage indexing pin 130 thereby retracting it from indexing detent 132 in the cartridge bar 106. Connecting bar 144 is also slidably mounted to bar 148. Therefore, further pulling of the handle 128 causes the connecting bar 144 to engage nut 150 at the end of bar 148 causing bar 148 to also translate to the left. Bar 148 contains a spring-loaded pawl 152 which engages sawtooth notches 154 on the cartridge bar 106. Thus the cartridge bar 106 is moved along with bar 148 until it is stopped by pin 156, anchored in the breach assembly 98, engaging the right hand edge of slot 158 in bar 148. Releasing the handle 128 will allow bar 142 to move to the right and allow indexing pin 130 to engage the next indexing detent 132 in the cartridge bar 106 as the cam surface 146 moves to the right. Further movement of the handle 128 and the rod 138 to the right causes the connecting bar 144 to bottom on the shoulder 160 of the bar 148 causing it to move to the right and to disengage pawl 152 from its present notch 154 and to allow it to reengage the notch 154 to its immediate right. Spring biased pawl 160 locks cartridge bar 106 in place while bars 142 and 148 and pawl 152 are returning to their original position. Since indexing pin 130 is engaged once again in indexing detent 132, microswitch 134 permits the firing mechanism to be actuated. Spring loaded ball 162 interacts with scalloped groove 164 to apply a uniform pressure on cartridge bar 106.

Figure 11:
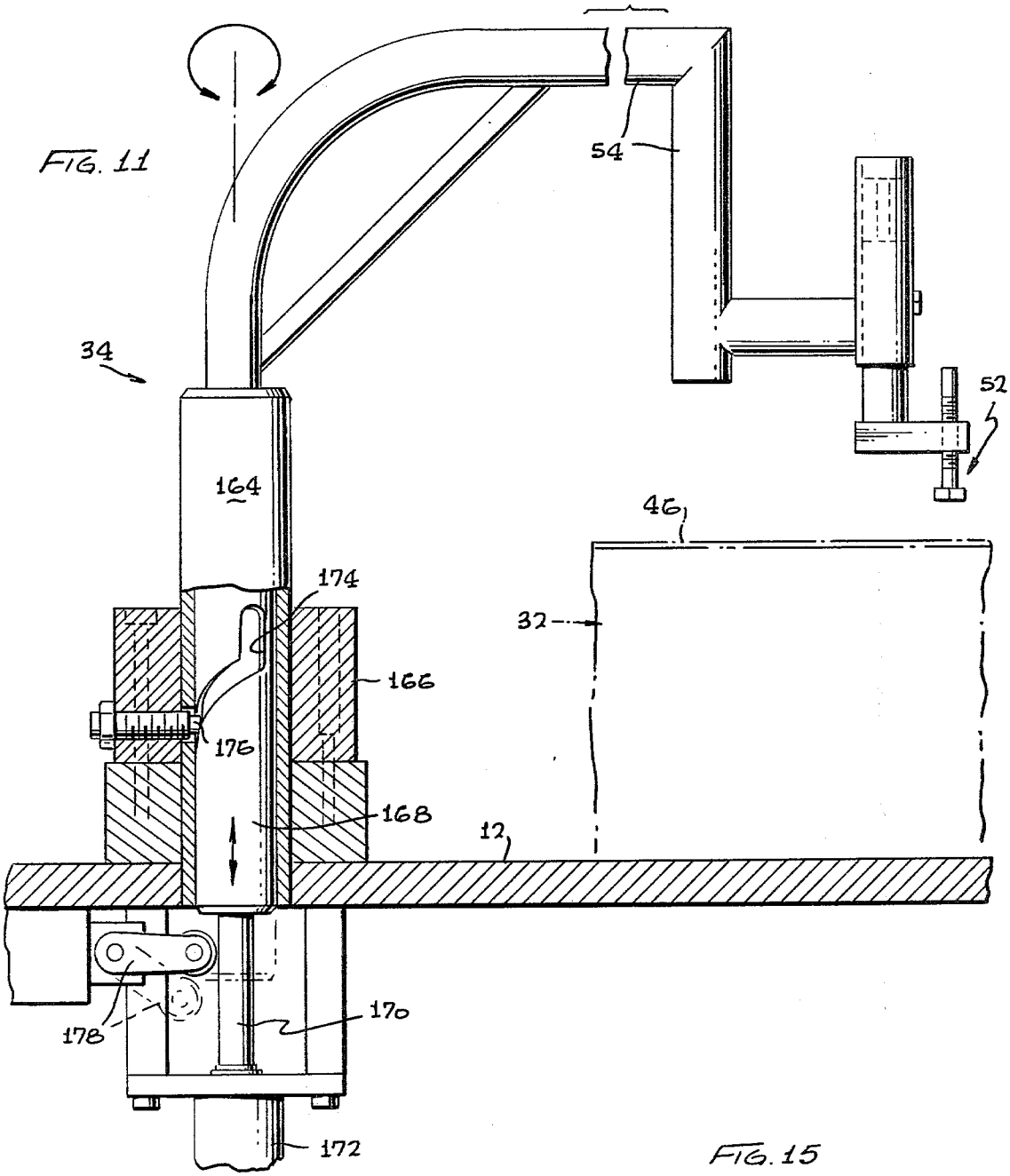
FIG. 11 is a side view, partially broken away, of the temperature sensor of the present invention taken along the lines 11—11 of FIG. 2.

In FIG. 11 the construction and operation of the temperature sensor 34 is illustrated. As described previously, temperature sensor 34 is designed to swing into position over the workpiece 46 to sense the temperature thereof and then to retract to the original position. In order to accomplish this, arm 54 having thermocouple 52 attached thereto is supported by sleeve 164 and block 166 mounted to cabinet 12. Lower portion 168 of arm 54 is coupled to piston 170 of pneumatic cylinder 172 and has groove 174 therein into which is inserted pin 176 secured by block 166. In operation, pneumatic cylinder 172 applies a downward force on the lower portion 168 of arm 54 causing it to descend and rotate due to the interaction of pin 176 and groove 174. After the arm 54 has executed approximately a 90° rotation, the final portion of the groove 174 causes the arm 54 and the thermocouple 52 to descend directly upon the surface of the workpiece 46 mounted on the die 32. The descent of the lower portion 168 of the arm 54 causes microswitch 178 to be actuated, as shown in phantom, and to render inoperative, as explained hereafter, the motion of the gantry bridge 16 so as to prevent damage to the temperature sensor 34. It is apparent that a subsequent upward force on piston 170 by pneumatic cylinder 172 will cause lower portion 168 of arm 54 and thus arm 54 and theremocouple 52 to initially rise straight up from the surface of the workpiece 46, thus preventing any damage to thermocouple 52, and then to cause arm 54 to execute a 90° rotation while continuing to rise to return to its original position.

Referring to FIGS. 12 through 14, form die 32 has a pair of body members 180, 180' which are held into position with the heater platens 30, 30' by lips 182 engaging brackets 78 on the heater platens 30, 30'. The body members 180, 180' are indexed together by loose fitting dowel 186 passing through the body members 180, 180' and into the heater platens 30, 30'. The body members 180, 180' have lifting holes 188 to enable the insertion of rods for the easy assembly and disassembly of the form die 32. The body members 180, 180' are recessed to accommodate replaceable anvils 190*a, b, c* and *d* and are precisely positioned by indexing pins 192 which are secured to the body members 180, 180' and are received by holes 194 in the anvils 190*a, b, c* and *d*. The anvils 190*a, b, c* and *d* are provided with lifting holes 196 into which rods may be inserted through the cutouts 198 in the body members 180, 180' to allow for rapid changes or alterations during production runs. The height of each of the anvils 190*a, b, c* and *d* may easily be adjusted by applying shims (not shown) between the body members 180, 180' and the anvils 190*a, b, c* and *d*. Anvils 190*a, b, c* and *d* are machined with lengthwise corner radii to match the configuration of workpiece 46 and anvils 190*a* and *b* are machined with transverse corner radii to correspond to the joggle transition radius. Thus, for example, edges 200, 202, 204 and 206 may be machined to have a radii of 0.03 inches, edges 208, 210, 212 and 214 may be machined to have a radii of 0.06 inches, edges 216 and 218 may be machined to have radii of 0.12 inches and edges 220 and 222 may be machined to have radii of 0.18 inches. Thus anvils 190 *a, b, c* and *d* may be rotated to present different lengthwise and transverse radii to match workpiece configuration and joggle transition radii and may be combined with other anvils, not shown, to provide other numerous combinations of lengthwise and transverse radii. Thus with a single pair of body members 180, 180', a plurality of anvils 190 and appropriate height adjusting shims, the form die 32 may be easily configured to accommodate numerous workpieces 46 and to achieve the desired deformation of such workpieces 46.

Figure 15:
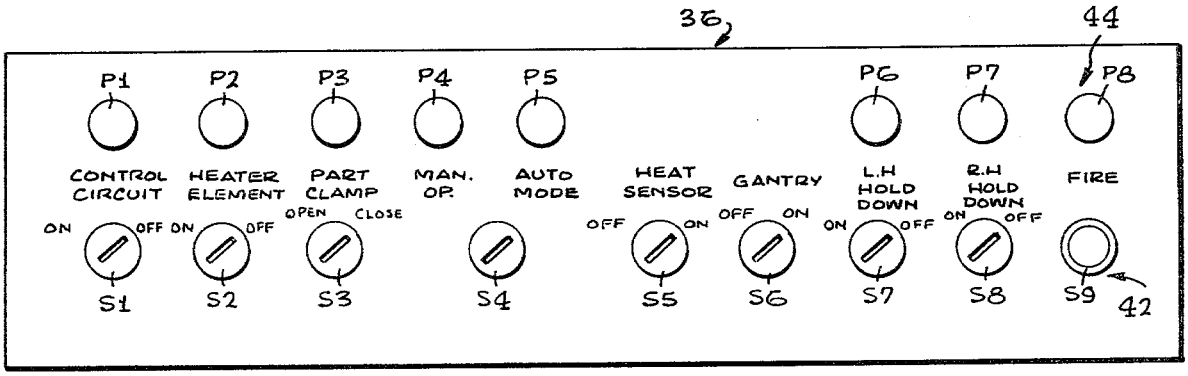
FIG. 15 is a top plan view of the operator console of the present invention.
Figure 16A:
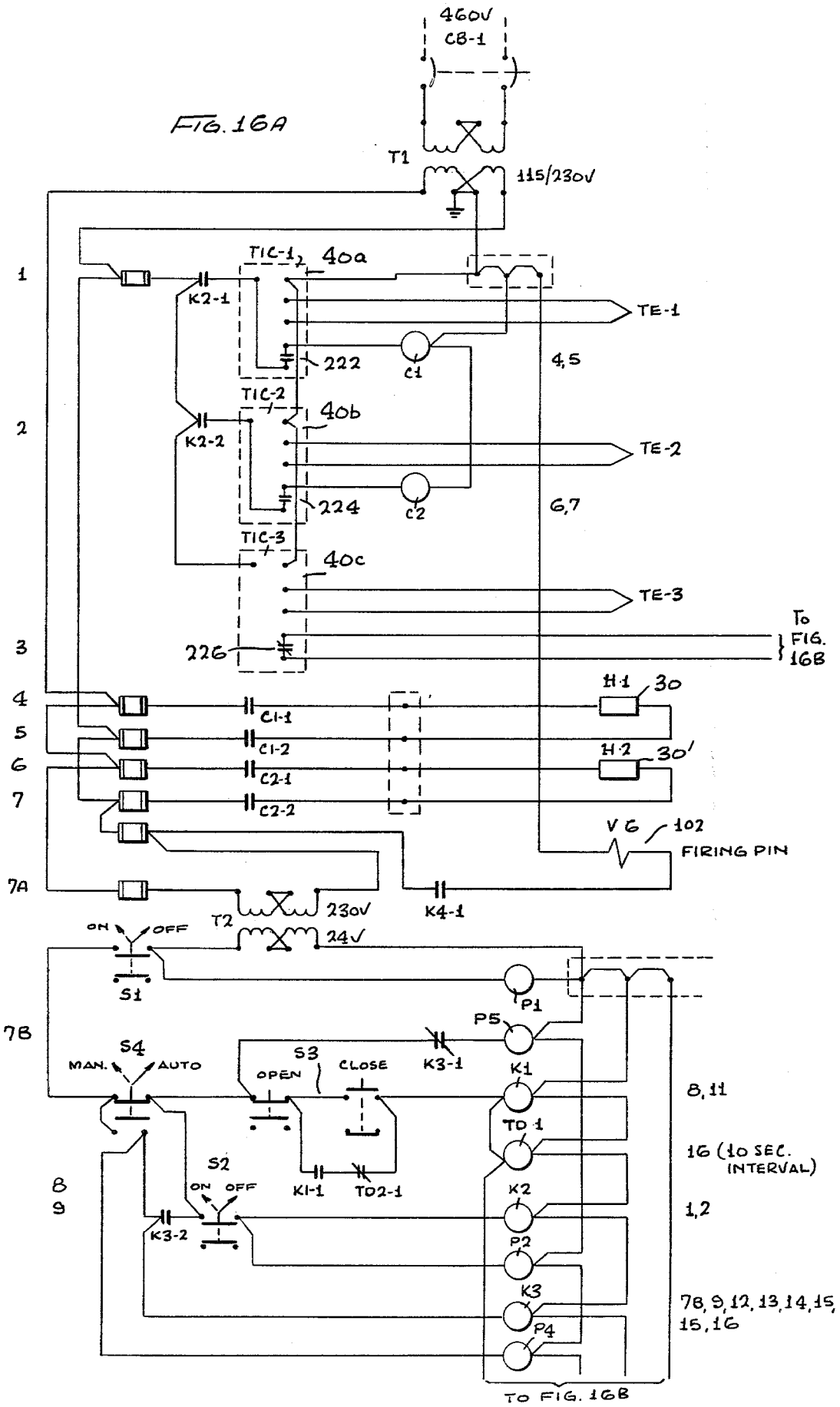
FIGS. 16A,B are a schematic illustration of the automatic sequencing circuitry of the present invention.
Figure 16B:
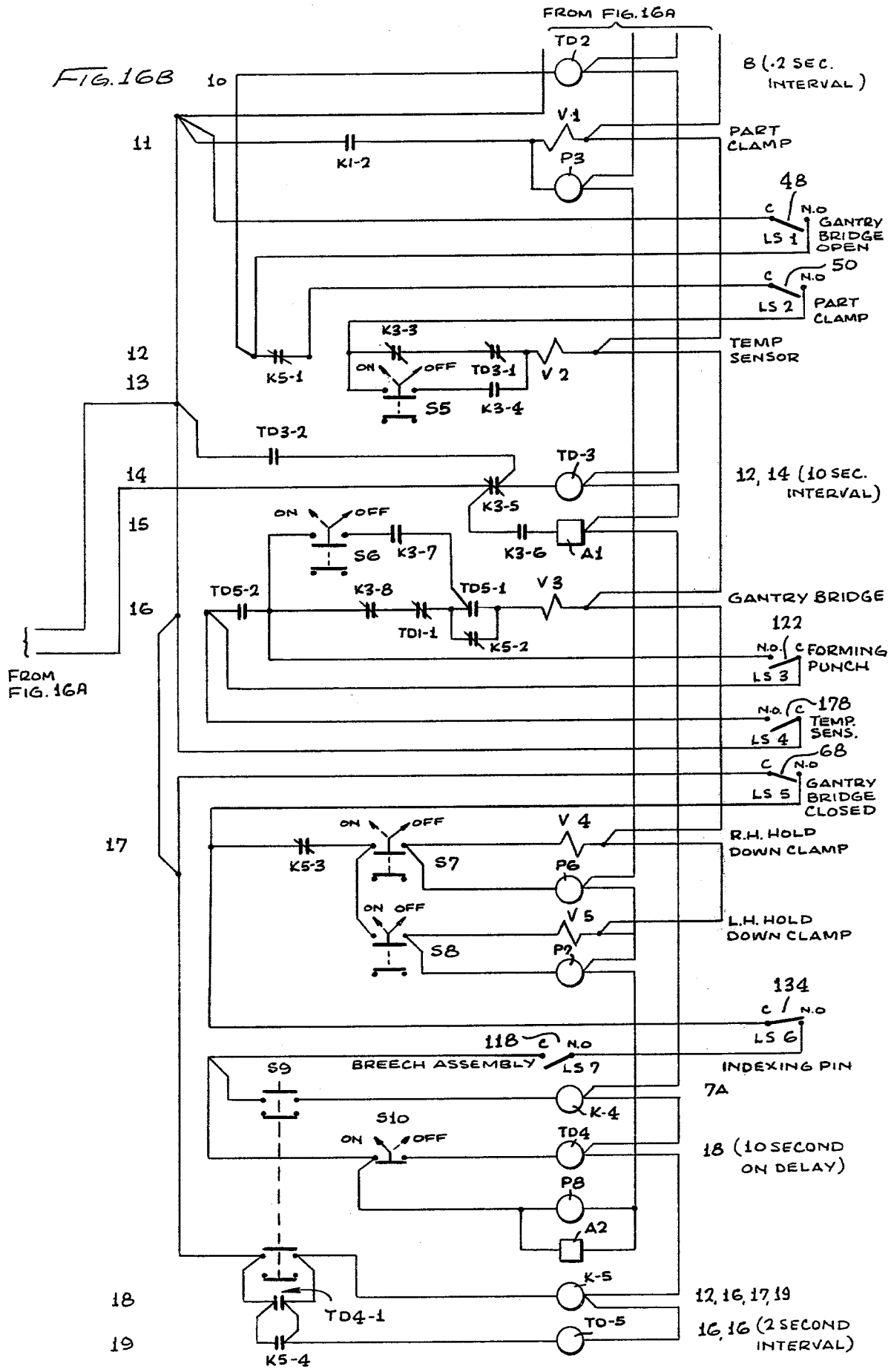

The automatic sequencing and operation of the present invention can best be understood with reference to FIG. 15 which illustrates the operator console 36, including operating switches 42 and indicator lights 44, and FIGS. 16A,B which are a schematic illustration of the automatic sequencing circuitry of the joggling machine 10. The joggling machine 10 is initially activated by turning on power switch 38 (shown in FIG. 1) which operates circuit breaker CB-1 located inside the cabinet 12, switch S10 which supplies power to delay relay TD4 which controls the automatic abort sequence, as explained hereafter, and control circuit switch S1 which supplies power to the remainder of the control circuit and whose ON position is indicated by indicator light P1. Heater element switch S2 is then placed in the ON position lighting indicator light P2 and causing control relay K2 to close normally open contacts K2-1 and K2-2 thus supplying power to temperature indicating controllers TIC-1 and TIC-2. Temperature indicating controller TIC-3 receives power when power switch 38 is turned on. These temperature indicating controllers are indicated by numerals 40*a, b* and *c* on FIG. 1 and serve to control the temperature of the heater platens 30, 30' and the temperature of the workpiece 46 through the thermocouple 52. The controllers TIC-1 and TIC-2 are set, for example, to 400° by rotating rotary temperature dials on the faces thereof and thermocouples TE-1 and TE-2 cause the normally open contacts 222 and 224 in controllers TIC-1 and TIC-2 to close thereby causing contactors C1 and C2 to close contacts C1-1, C1-2, C2-1 and C2-2 to thereby supply power to heater elements H1 and H2 corresponding to the heater platens 30, 30' shown in FIG. 1. Temperature indicating controller TIC-3 is set, for example, to 300° and contact 226 is held in a normally open position by the application of the line voltage until it is closed when thermocouple TE-3 indicates that the workpiece 46 is up to temperature.

At this point in the operating cycle, hold-down switches S7 and S8 are turned on, as desired, so that the hold-down clamps 80 and 82 will be activated in the proper sequence when the workpiece 46 is ready to be joggled. The cartridge bar 106 is also inserted and the breach assembly 98 is closed thereby closing microswitches LS6 and LS7 corresponding to microswitches 134 and 118 indicating the positions of the detent pin 124 and the breach assembly 98. At this point in the sequence, limit switch LS1, corresponding to microswitch 48, is closed indicating that the gantry bridge 16 is in the gantry bridge open position away from the workpiece 46, limit switch LS2, corresponding to microswitch 50, is open indicating that the clamp 22 is open, limit switch LS3, corresponding to microswitch 122, is closed indicating that the forming punch 110 is in position, limit switch LS4, corresponding to microswitch 178, is open indicating that the temperature sensor 34 is out of position away from the workpiece 46 and limit switch LS5, corresponding to microswitch 68, is open indicating that the gantry bridge 16 is not in the gantry bridge closed position over the workpiece 46.

In order for the joggling machine 10 to sequence automatically, mode switch S4 is then placed in the automatic mode position and indicator light P5 lights to indicate as such. Heat sensor switch S5 and gantry switch S6 can be placed in either the OFF or the ON position since contacts K3-4 and K3-7 are normally open, thus rendering such switches inoperable during the automatic sequencing mode. Part clamp switch S3 is then rotated to the CLOSED position energizing relay K1. Relay K1 closes contacts K1-1 and K1-2 thereby keeping power across the part clamp switch S3 since it is spring loaded to open and supplying power to solenoid V1 to cause the clamp 22 to close and the indicator light T3 to go on. In addition, K1 energizes interval delay relay TD1 which causes contact TD1-1 in the gantry bridge circuit to open and remove power from the gantry solenoid V3 for a period of 10 seconds. During this 10 second period of time, clamp 22 closes thereby closing limit switch LS2 and causing solenoid V2 to be energized to bring the temperature sensor 34 over the workpiece 46 to control the temperature thereof. At this time, limit switch LS4 opens thereby cutting all power off to the gantry bridge circuit so that the gantry bridge 16 is rendered inoperative from moving while the thermocouple 52 is in contact with the workpiece 46. When the temperature of the workpiece 46 reaches 300° as measured by thermocouple TE-3, contact 226 of controller TIC-3, which has been held open by the line voltage, is then closed causing interval delay relay TD3 to open contact TD3-1 for 10 seconds which deenergizes solenoid V2 and allows the temperature sensor 34 to return to its original position. Switch TD3-2 is closed during this 10 second period of time to shunt controller TIC-3 so that the voltage stays on relay TD3 for 10 seconds when the thermocouple TE-3 is lifted from the workpiece 46, as the drop in temperature of the thermocouple TE-3 would cause contact 226 to open and remove voltage from relay TD3. When limit switch LS4 is closed by the return of temperature sensor 34, power is applied to solenoid V3 which thus causes the gantry bridge 16 to move over the workpiece 46.

When the gantry bridge 16 is in position over the workpiece 46 limit switch LS5 is closed thus causing power to be applied to solenoids V4 and V5 causing hold down-clamps 80 and 82 to extend down onto the workpiece 46 and also causing indicator lights P6 and P7 to light. At the same time, power is applied to red fire light P8 and buzzer A2 to indicate that the fire circuit is ready to be activated and on-delay relay TD4 (set for a 10 second delay). If the fire switch S9 is pressed within the 10 second delay period, relay K4 is energized closing contact K4-1 and energizing solenoid V6 which actuates firing pin 102 to cause cartridge 104 to detonate and form an explosure gas in chamber 109 which drives forming punch 110 and causes workpiece 46 to be joggled. At the same time relay K5 is energized causing contacts K5-1, K5-2 and K5-3 to open and contact K5-4 to close. Contact K5-1 prevents the temperature sensor 34 from coming over the workpiece 46 when the gantry bridge 16 moves to the gantry bridge open position and closes switch LS1. Contact K5-3 causes power to be cut off from solenoids V4 and V5 thus allowing the hold-down clamps 80 and 82 to retract. Contact K5-4 holds the contacts K5-1, K5-2 and K5-3 in their open position and also energizes interval delay relay TD5. Relay TD5 causes contacts TD5-1 and TD5-2 to close for 2 seconds while contact K5-2 is open. This allows power to stay on the gantry solenoid V3 for a period of 2 seconds until the hold-down clamps 80 and 82 are able to retract. After 2 seconds have elapsed, contacts TD5-1 and TD5-2 are opened causing, along with open switch K5-2, power to be removed from solenoid V3 and the gantry bridge 16 to retract to the gantry bridge open position. When the gantry bridge 16 reaches the gantry bridge open position, limit switch LS1 is closed and delay relay TD2 is energized causing contact TD2-1 to open for a 0.2 second interval. This causes clamp switch S3 to open and deenergize relay K1 which opens contact K1-2 thus removing power from solenoid V1 and causing clamp 22 to open releasing the workpiece 46. If the fire switch S9 is not activated within 10 seconds, the sequence is aborted since on-delay relay TD4 closes, causing contact TD4-1 to close thereby energizing relay K5 which in turn causes contact K5-4 to close and relay TD5 to be energized. The abort sequence is thus identical to the previous firing sequence with the on-delay relay performing essentially the function of the fire switch S9. It should be noted that when the gantry bridge 16 begins to move to the gantry bridge open position limit switch LS5 opens thereby cutting off power to switches S7, S8 and S9. It should also be noted that open contact TD5-2 prevents solenoid V3 for the gantry bridge 16 from being energized in the event that limit switch LS3 is open indicating the forming punch 110 is not in position. Finally, it should be noted that the abort sequence can be delayed indefinitely by setting switch S10 to the OFF position.

As is apparent, the joggling machine 10 can also be operated in a manual mode with the mode switch S4 being put in the manual operation position. In this position, relay K3 is activated thereby opening contact K3-1 so that indicator light P5 does not light, closing contact K3-2 coupled to the heater element switch S2, opening contact K3-3 and closing contact K3-4 thereby requiring that heat sensor switch S5 be operated manually, opening contact K3-5 and closing contact K3-6 thereby inactivating relay TD3 and causing buzzer A1 to sound when the workpiece 46 is up to temperature so that the temperature sensor 34 may be manually deenergized by switch S5, and closing switch K3-7 and opening switch K3-8 so that the gantry switch S6 will have to be manually operated to bring the gantry bridge 16 into position over the workpiece 46. It should be noted that the automatic return sequence is the same as if the switch S4 were in the automatic mode position.

Having thus described the invention, it is obvious that numerous modifications and departures may be made by those skilled in the art; thus, the invention is to be construed as being limited only by the spirit and scope of the appended claims.

What is claimed is:

1. A joggling machine incuding a joggling tool for forming an indentation in a workpiece comprising:

means for securing said workpiece;

means for heating said workpiece to a preselected temperature;

means for supporting said joggling tool above the plane of said workpiece and for moving said joggling tool into position over said workpiece prior to actuating said joggling tool; and means for actuating said joggling tool after said joggling tool has moved into position over said workpiece.

2. The joggling machine of claim 1, wherein said means for securing said workpiece includes first and second clamp means movable with respect to one another in the plane of said workpiece and adapted to secure said workpiece therebetween, said first clamp means being stationary with respect to said second clamp means.

3. The joggling machine of claim 2, further including means for determining the position of said second clamp means.

4. The joggling machine of claim 1, wherein said means for heating said workpiece includes sensor means for determining the temperature of said workpiece.

5. The joggling machine of claim 4, further comprising means for bringing said sensor means into contact with said workpiece when said workpiece has been secured and for retracting said sensor means when said workpiece attains said preselected temperature.

6. The joggling machine of claim 5, further comprising means for determining the position of said sensor means.

7. The joggling machine of claim 1, further comprising means for determining when said joggling tool is positioned over said workpiece and when said joggling tool is in a retracted position.

8. The joggling means of claim 5, further comprising means for actuating said means for moving said joggling tool when said sensor means has retracted from said workpiece.

9. The joggling machine of claim 1, wherein said joggling tool includes a punch member and further comprising means for determining the position of said punch member of said joggling tool.

10. The joggling machine of claim 1, wherein said joggling tool includes a breach portion and further comprising means for determining the position of said breach portion of said joggling tool.

11. The joggling machine of claim 1, wherein said joggling machine includes a punch member and further comprising means for resetting said punch member of said joggling tool.

12. The joggling machine of claim 1, further comprising means for controlling the motion of said means for moving said joggling tool to prevent surging.

13. The joggling machine of claim 1, further comprising means for exerting a downward force on said workpiece after said joggling tool has moved into position over said workpiece.

14. The joggling machine of claim 8, further comprising means for exerting a downward force on said workpiece after said joggling tool has moved into position over said workpiece.

15. The joggling machine of claim 1, further comprising means for automatically sequencing the operation of forming said indentation in said workpiece.

16. The joggling machine of claim 1, further comprising means for aborting the actuation of said joggling tool.

17. The joggling machine of claim 1, wherein said joggling tool includes a barrel and is explosively actuated and further comprising a multiple chambered magazine for use in said explosively actuated joggling tool, said magazine comprising:

a bar;

a plurality of chambers in said bar to receive explosive cartridges;

engaging means for enabling said bar to be moved relative to said barrel; and indexing means for aligning said chambers with the bore chamber of said barrel.

18. The magazine of claim 17, wherein said indexing means includes a plurality of indexing detents in said bar, and said joggling tool includes a spring biased indexing pin adapted to be secured in said detents and means for disengaging said indexing pin from said detents.

19. The magazine of claim 18, wherein said means for disengaging said indexing pin from said detents includes cam means and translation means coupled to said cam means and said bar to move said bar relative to said barrel.

20. The magazine of claim 17, wherein said engaging means includes a plurality of notches in said bar, and said joggling tool includes pawl means adapted to engage one or more of said notches.

21. The magazine of claim 20, wherein said joggling tool includes translation means coupled to said pawl means to move said bar relative to said barrel and spring means for returning said translation means to its original position after the movement of said bar.

22. The magazine of claim 21, further including means for limiting the movement of said translation means.

23. The magazine of claim 17, further including means for allowing only unidirectional movement of said bar.

24. The magazine of claim 17, further including means for determining the alignment of said chambers in said bar and said bore chamber of said barrel.

25. The joggling machine of claim 1, wherein said means for securing said workpiece further includes a form die operable in conjunction with said forming tool for forming said indentation in said workpiece, said form die comprising:

a pair of body members adapted to secure said workpiece therebetween, each of said body members having accommodation means in the upper surfaces thereof; and a plurality of anvil members adapted to be constrained by said accommodation means and configured in combination to match the desired indentation of said workpiece.

26. The form die of claim 25, wherein said accommodation means comprises recesses in said upper surfaces and said anvil members are inserted into said recesses.

27. The form die of claim 25, further comprising means for adjusting the relative heights of said anvil members.

28. The form die of claim 25, wherein said body members have locating members thereon to align said body members with respect to one another.

29. The form die of claim 25, wherein said anvils have a plurality of radii on the edges thereof.

30. The form die of claim 25, wherein said body members have means thereon to position said anvil members.

31. A joggling machine including a joggling tool for forming an indentation in a workpiece comprising:

means for securing said workpiece;

means for heating said workpiece to a preselected temperature;

sensor means for determining the temperature of said workpiece;

means for bringing said sensor means into contact with said workpiece when said workpiece has been secured and for retracting said sensor means when said workpiece attains said preselected temperature;

means for moving said joggling tool and said workpiece into proximity with one another; and means for actuating said joggling tool.

32. The joggling machine of claim 31, further comprising means for determining the position of said sensor means.

33. The joggling means of claim 31, further comprising means for actuating said means for moving said joggling tool when said sensor means has retracted from said workpiece.

34. The joggling machine of claim 33, further comprising means for exerting a downward force on said workpiece after said joggling tool and said workpiece have moved into proximity with one another.

* * * * *